US005277713A

United States Patent [19]

Gelain et al.

[11] Patent Number: 5,277,713

[45] Date of Patent: Jan. 11, 1994

[54] CABIN FOR SPRAY COATING OBJECTS WITH POWDER

[75] Inventors: Silvano Gelain, Abtwil; Bernhard Dinkel, St. Gallen, both of Switzerland

[73] Assignee: Gema Volstatic AG, St. Gallen, Switzerland

[21] Appl. No.: 960,632

[22] Filed: Oct. 14, 1992

[30] Foreign Application Priority Data

Oct. 21, 1991 [DE] Fed. Rep. of Germany ..... 4134702

[51] Int. Cl.[5] ..... B05B 5/025

[52] U.S. Cl. ..... 118/634; 118/64; 118/309

[58] Field of Search ..... 118/64, 309, 629, 634

[56] References Cited

U.S. PATENT DOCUMENTS 3,726,701 4/1973 Nishikawa et al. ..... 118/634 X
3,921,576 11/1975 Vertue ..... 118/634
4,715,314 12/1987 Ramseier et al. ..... 118/634 X
5,169,673 12/1992 Demeny et al. ..... 118/634 X

*Primary Examiner*—David A. Simmons
*Assistant Examiner*—Paul M. Rivard

[57] ABSTRACT

The cabin walls (30) and preferably also the cabin floor (34) and/or the cabin ceiling (36) each consist of a double-walled construction with an inner wall (40), an outer wall (44), and spacer elements (46) which keep the two walls spaced apart. Each wall consists of several layers (1 to 9), in sandwich construction, where the layer (1), which delimits the spray space (42) of the cabin, consists of polypropylene or of polyvinyl chloride plastic.

22 Claims, 1 Drawing Sheet

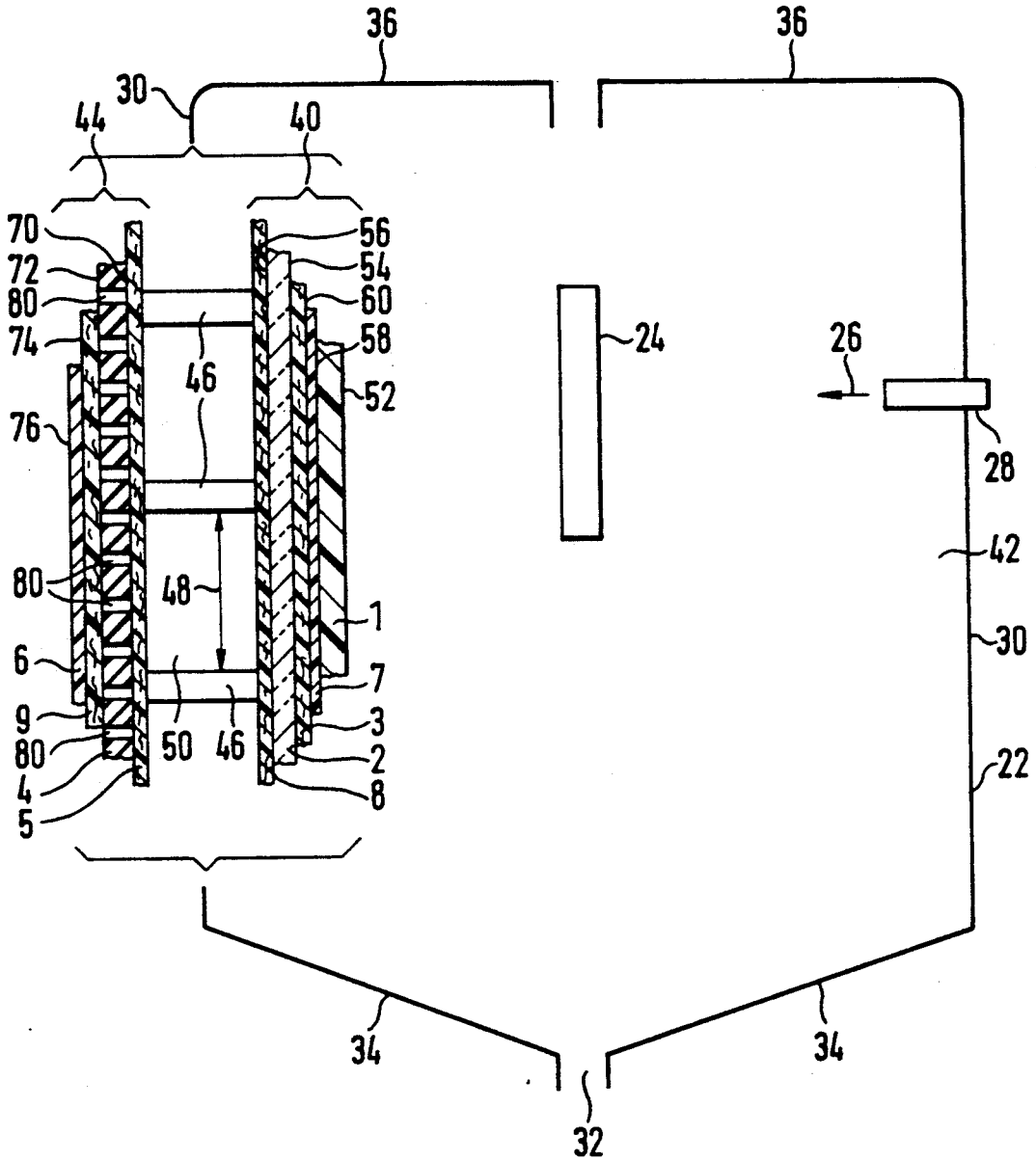
36
36
30
44
40
70
72
80
74
76
80
6
9
80
4
5
56
54
60
58
52
46
48
1
7
3
2
8
50
46
24
26
28
42
30
22
34
34
32

CABIN FOR SPRAY COATING OBJECTS WITH POWDER

FIELD OF THE INVENTION

The present invention relates generally to spray coating apparatus or systems, and more particularly to a cabin for electrostatically spray coating objects with powder.

BACKGROUND OF THE INVENTION

Such a cabin is known from DE-OS 39 19 614. Furthermore, EP 0 162 784 B1 also shows a cabin made of plastic.

OBJECT OF THE INVENTION

In accordance with the present invention, a cabin is to be created which offers great reliability against electrical arcing, with no powder particles collecting at its inner surfaces which form the spray space of the cabin, if possible, and which can be cleaned quickly, where the design of the cabin is supposed to be such that the cabin can be produced in an inexpensive manner.

SUMMARY OF THE INVENTION

This task is accomplished, according to the invention, with the combination of the features stated more particularly within the succeeding specification;

With the present invention, the advantages obtained are that the cabin can be produced in a very inexpensive manner, and nevertheless offers great reliability against electrical arcing, and is electrostatically neutral, or has a repelling effect for many different kinds of powder, so that no or only a few powder particles can collect on the inner surfaces of the cabin. The smoothness of the inner and outer surfaces of the cabin also contributes to the fact that no powder particles or dust particles can collect on them. Furthermore, the extreme smoothness of the inner and outer surfaces of the cabin allows rapid but nevertheless thorough cleaning of the cabin.

Further characteristics of the invention which support these advantages are more fully described in the succeeding specification.

BRIEF DESCRIPTION OF THE DRAWING

Various other objects, features, and attendant advantages of the present invention will become more fully appreciated from the following specification, while referring to the enclosed drawing, which illustrates a preferred embodiment as an example, and wherein:

The Figure is a schematic horizontal cross-section of a cabin constructed according to the present invention, with details of a cabin wall shown on an enlarged scale.

DETAILED DESCRIPTION OF THE ILLUSTRATED EMBODIMENT

The cabin 22 for spray coating objects 24 with electrostatically charged powder 26 from a spray device 28 essentially consists of cabin walls 30 in the longitudinal cabin direction, a cabin floor 34 inclined downwards towards a central drainage channel 32, and a cabin ceiling 36. The cabin walls 30, and preferably also the cabin floor 34 and the cabin ceiling 36, are structured as electrical insulators, and consist of several layers, in sandwich construction, at least one layer of which consists of plastic. All of the plastic layers described in the following are preferably fiber-reinforced plastic layers or plastic sheets, where glass fibers preferably serve as the fibers. Pursuant to the enlarged cross-sectional detail of a cabin wall 30 in the drawing, the cabin walls 30, and preferably also the cabin floor 34 and the cabin ceiling 36, consist of a double-wall construction consisting of an inner wall 40, which delimits the spray space 42, an outer wall 44, and a plurality of spacer elements 46, which rigidly connect the two walls 40 and 44, which are arranged at a distance from one another, and are arranged at a reciprocal distance 48 from one another, so that the two walls 40 and 44, which are also arranged at a distance from one another, form a cavity 50 or a plurality of cavities between themselves and between the spacer elements. The inner wall 40 consists of the layers 1, 7, 3, 2 and 8, which adhere to each other in that sequence, and the outer wall 44 consists of the layers 5, 4, 9 and 6, which adhere to each other in that sequence. The spacer elements 46 preferably consist of foamed polyurethane or polyvinyl chloride plastic, which adheres to the inner wall 40 and the outer wall 44, and forms a rigid double wall in doing so. "Adhere" means that the layers are glued together in each case by means of their own adhesion, without any additional adhesive, in that the layers, which each consist of plastic or resin, are applied to one another in the paste or liquid state, and thereby adhere to each other or melt together at the border surface In a different embodiment, adhesive could also be used between the layers to be connected with each other, but the preferred embodiment consists in having the individual layers glued together by their own adhesion capacity in the paste state, during production.

The inner wall 40 consists of a first layer 1 of plastic, preferably polypropylene or polyvinyl chloride; preferably in the form of a sheet covered with an agent to promote adhesion, where the surface 52 which is on the inside of the cabin delimits the spray space 42 and is very smooth, so that powder particles 26 do not adhere to it, but rather slide off; a second layer 2 in the form of a sheet of ceramic material or a composition which predominantly contains ceramic material; a third layer 3 of plastic, preferably fiberglass-reinforced plastic, which is glued onto the surface 54 of the second layer which faces the spray space 42, preferably by means of the inherent adhesion forces of the third layer 3, in that it is applied to the second layer in the paste state; an eighth layer 8 of plastic, preferably fiberglass-reinforced plastic, which was applied to the surface 56 of the second layer 2 which faces away from the spray space 42 in the paste state, and therefore adheres to this surface 56; and a seventh layer 7 of a thixotropic resin, which is known under the name Gel Coat, cures with exclusion of air and does not tend to drip, or drips only slightly, when applied to a vertical surface in the paste state, where the seventh layer 7 adheres both to the surface 58 of the first layer 1 which faces away from the spray space 42, and to the surface 60 of the third layer 3 which faces towards the spray space 42, in that it was brought into contact with both surfaces 58 and 60 when it had not yet cured. For PP, an "agent to promote adhesion" is here understood to mean a woven material, netting or similar material which adheres to the sheet or layer 1 and increases adhesion. For PVC, an "agent to promote adhesion" is here understood to mean a bonding fluid applied to the PVC layer 1.

The outer wall 44 consists of a fourth layer 4 of electrically insulating material as the carrier element for a layer 5 of plastic, preferably fiberglass-reinforced plastic, arranged on its surface 70 which faces towards the spray space 42, and adhering to it there, and for a ninth layer 9 of plastic, preferably fiberglass-reinforced plastic, applied to its surface 72 which faces away from the spray space 42, where the fifth layer 5 and the ninth layer 9 were each applied to the layer 4 in the paste state, and therefore adhere to the fourth layer due to their inherent adhesion, before curing; and a sixth layer 6 of a thixotropic resin, a so-called Gel Coat, which cures with exclusion of air and does not tend to drip when applied to vertical surfaces, where the sixth layer 6 was applied to the surface 74 of the ninth layer 9 facing away from the spray space 42 in the paste state, in such a way that it forms an adhesion connection with this surface 74.

Preferably, the plastic layers 3, 5, 8 and 9 are structured the same, they particularly consist of the same material and have the same thickness. Preferably, the layer 6 also consists of the same material and has the same thickness as the layer 7. The outer surface 76 of the sixth layer 6 of Gel Coat, which faces away from the spray space 42, is very smooth.

The ninth layer 9 is adhesive during production due to its inherent adhesion forces, and after curing is connected with the fourth layer 4 on the one side and with the outer layer 6 on the other side, which latter layer forms the outer surface 76 of the cabin.

The fourth layer 4 is a honeycomb-like or grid-like reinforcement element of electrically insulating material, with channels 80, which preferably pass through laterally, into which the material of the adjacent layers enters. In a changed embodiment, the layer 4 can consist of ceramic material or a composition consisting mainly of ceramic material. The layer 4 connects the two layers 5 and 9, which are adjacent to it on both sides. The channels 80, which pass through laterally, are open in the two surfaces of the layer or sheet 4.

To reduce the costs, the composite wall construction of the Figure can be simplified in that at least one of the layers 7 and/or 8 and/or 9 is left out.

Preferably, a non-flammable material or one with low flammability is used as the material for the individual layers and the spacer elements 46, for example a non-flammable polypropylene or one with low flammability with regard to the layer or sheet 1.

The layers 3, 8, 5 and 9 can each have the form of films, but are preferably brushed or sprayed onto the layer 2 or the layer 4 in the liquid or paste state. The layers 6 and 7 are preferably also brushed or sprayed onto the other layers. The layers 2 and 4, which serve as spacer elements and carrier layers, are preferably at least twice as thick as each of the other layers. All layers have a thickness between 0.5 mm and 8 mm.

Obviously, many modifications and variations of the present invention are possible in light of the above teachings. It is therefore to be understood that within the scope of the appended claims, the present invention may be practiced otherwise than as specifically described herein.

We claim:

1. A cabin for electrostatically spray coating objects disposed therein with powder, comprising:

a floor;

a ceiling; and a plurality of walls interconnecting said floor and said ceiling;

each one of said plurality of walls comprising a double-walled construction defined by means of a first inner wall component comprising electrically insulating material and having a smooth continuous surface which defines an inner wall surface of said cabin whereby said inner wall surfaces of said first inner wall components of said plurality of walls surroundingly define a spray space within said cabin within which said objects to be coated are disposed; a second outer wall component comprising electrically insulating material and spaced from said first inner wall component such that a cavity is defined between each one of said first and second inner and outer wall components; and a plurality of electrically insulating spacer elements extending through said cavities defined between each one of said first and second inner and outer wall components and interconnecting said first and second inner and outer wall components together such that a rigidified wall structure, comprising said inner and outer wall components and said spacer elements connected thereto, which is electrically insulative is defined so as to effectively prevent electrical arcing while powder particles are also effectively prevented from adhering to and collecting upon said smooth continuous surfaces of said inner wall components.

2. Cabin according to claim 1, characterized by the fact that the spacer elements consist of polyurethane or polyvinyl chloride plastic are foamed, and adhere to the inner wall and the outer wall, and form a rigid double wall in doing so.

3. Cabin according to claim 1, characterized by the fact that the cabin ceiling is structured in the same way as the cabin walls.

4. Cabin according to claim 1, characterized by the fact that the cabin floor is structured in the same way,. as the cabin walls.

5. A cabin as set forth in claim 1, wherein:

each one of said first inner wall components and each one of said second outer wall components comprises a sandwich construction of a plurality of wall component layers.

6. A cabin as set forth in claim 5, wherein:

at least one of said plurality of wall component layers of each one of said first and second inner and outer wall components comprises a plastic material.

7. A cabin as set forth in claim 6, wherein:

said plastic material comprises a fiber-reinforced plastic material.

8. A cabin as set forth in claim 5, wherein:

each one of said first inner wall components comprises a first wall component layer comprising a plastic material, a second wall component layer comprising a ceramic material, and a third wall component layer interposed between said first and second wall component layers and comprising a plastic material.

9. A cabin as set forth in claim 8, wherein:

said third wall component layer comprises fiber-reinforced plastic material.

10. A cabin as set forth in claim 8, wherein:

said first wall component layer is disposed innermost with respect to said spray space of said cabin so as to define said inner wall surface of said cabin, while said second wall component layer is disposed outwardly of said first wall component layer, with respect to said spray space of said cabin, so as to be disposed closer to said cavity defined between each one of said first and second inner and outer wall components.

11. A cabin as set forth in claim 8, wherein:

each one of said second outer wall component comprises a fourth wall component layer comprising an electrically insulating material, a fifth wall component layer comprising a plastic material and disposed upon a first side of said fourth wall component layer which is disposed toward said spray space of said cabin, and a sixth wall component layer comprising an electrically insulating material and disposed upon a second side of said fourth wall component layer which is disposed away from said spray space of said cabin.

12. A cabin as set forth in claim 11, wherein:

said fifth wall component layer of plastic material comprises a fiber-reinforced plastic material.

13. Cabin according to claim 8, characterized by the fact that the first, wall component layer is a sheet of polypropylene with low flammability.

14. Cabin according to claim 8, characterized by the fact that the first wall component layer is a sheet of polyvinyl chloride plastic.

15. 4. Cabin according to claim 11, characterized by the fact that the sixth, wall component layer, which forms a smooth surface (76) on the outside of the cabin consists of a thixotropic resin which can cure as a result of the exclusion of air.

16. Cabin according to claim 11, characterized by the fact that the first wall component layer layer and the third wall component layer of the inner wall are glued together by a seventh wall component layer of electrically insulating material, which consists of the same material as the outer sixth wall component layer of the outer wall.

17. Cabin according to claim 16, characterized by the fact that an eighth wall component layer of plastic is arranged on the surface of the second wall component layer which faces away from the spray space and adheres to it.

18. Cabin according to claim 11, characterized by the fact that the fourth wall component layer of the outer wall consists of a honeycomb-like or grid-like element of electrically insulating material, provided with a plurality of channels.

19. Cabin according to claim 11, characterized by the fact that the fourth wall component layer of the outer wall is a sheet which consists of ceramic material or a composition consisting mainly of ceramic material.

20. Cabin according to claim 11, characterized by the fact that the fourth wall component layer of the outer wall consists of the same material and has the same thickness as the second wall component layer of the inner wall.

21. Cabin according to claim 11, characterized by the fact that a ninth wall component layer of plastic is arranged between the fourth wall component layer and the sixth wall component layer of the outer wall and adheres to both fourth and sixth wall component layers.

22. A cabin as set forth in claim 20, wherein:

said thickness of said second and fourth wall component layers is each within the range of 0.5–8 mm.

* * * * *